US007066452B2

(12) United States Patent
Rotering et al.

(10) Patent No.: US 7,066,452 B2
(45) Date of Patent: Jun. 27, 2006

(54) HUMIDIFIER WITH REVERSE OSMOSIS FILTER

(75) Inventors: Leisha J. Rotering, Minneapolis, MN (US); Timothy J. Kensok, Minnetonka, MN (US)

(73) Assignee: Honeywell International Inc., Morristown, NJ (US)

( * ) Notice: Subject to any disclaimer, the term of this patent is extended or adjusted under 35 U.S.C. 154(b) by 28 days.

(21) Appl. No.: 10/636,064

(22) Filed: Aug. 7, 2003

(65) Prior Publication Data

US 2004/0070091 A1 Apr. 15, 2004

Related U.S. Application Data

(60) Provisional application No. 60/417,919, filed on Oct. 11, 2002.

(51) Int. Cl.
*B01F 3/04* (2006.01)

(52) U.S. Cl. ..... 261/142; 261/70; 261/DIG. 15; 261/DIG. 46

(58) Field of Classification Search ..... 261/70, 261/141, 142, DIG. 10, DIG. 15, DIG. 29, 261/DIG. 46; 210/104, 128, 181
See application file for complete search history.

(56) References Cited

U.S. PATENT DOCUMENTS

| | | | | |
|---|---|---|---|---|
| 3,630,378 | A | 12/1971 | Bauman | |
| 3,726,793 | A | 4/1973 | Bray | |
| 3,846,295 | A | 11/1974 | Gibbs | |
| 4,257,989 | A | 3/1981 | Nishikawa | |
| 4,626,346 | A | 12/1986 | Hall | |
| 4,650,586 | A | 3/1987 | Ellis, III | |
| 4,668,854 | A * | 5/1987 | Swan | 392/399 |
| 4,724,104 | A | 2/1988 | Kim | |
| 4,770,770 | A | 9/1988 | Regunathan et al. | |
| 4,997,553 | A | 3/1991 | Clack | |
| 5,128,035 | A | 7/1992 | Clack et al. | |
| 5,256,279 | A | 10/1993 | Voznick et al. | |
| 5,341,986 | A * | 8/1994 | Galba et al. | 236/11 |
| 5,407,604 | A * | 4/1995 | Luffman | 261/4 |
| 5,445,143 | A | 8/1995 | Sims | |
| 5,880,438 | A | 3/1999 | Parrini et al. | |
| 5,906,800 | A | 5/1999 | Napierkowski et al. | |
| 5,976,363 | A * | 11/1999 | Monroe et al. | 210/90 |
| 6,053,482 | A | 4/2000 | Glenn et al. | |
| 6,103,125 | A | 8/2000 | Kuepper | |
| 6,120,682 | A | 9/2000 | Cook | |

(Continued)

FOREIGN PATENT DOCUMENTS

JP 62-095189 5/1987

(Continued)

OTHER PUBLICATIONS

Exhibit A—"Pure Water—Pure water for air humidification systems," *AB SIBE International,* 2 pages (1999).

(Continued)

*Primary Examiner*—Scott Bushey
(74) *Attorney, Agent, or Firm*—Gregory M. Ansems

(57) ABSTRACT

A filtering system for use with a reservoir. The filter system includes a filter assembly capable of filtering particles sized 1.0 micrometers and larger and may, include a flow control device positioned to selectively provide fluid flow to the filter assembly. The flow control device may include an electrically actuated valve, such as a solenoid valve. The filter system may also include a fluid level detection mechanism operatively connected to the flow control valve. The filtering system is especially applicable to humidifier systems having a heat source

14 Claims, 9 Drawing Sheets

U.S. PATENT DOCUMENTS

| | | | | |
|---|---|---|---|---|
| 6,190,558 | B1 | 2/2001 | Robbins | |
| 6,253,964 | B1 * | 7/2001 | Rainey | 222/148 |
| 6,339,952 | B1 * | 1/2002 | Potter et al. | 73/40 |
| 6,375,849 | B1 | 4/2002 | Crabtree et al. | |
| 6,394,427 | B1 * | 5/2002 | Guetersloh et al. | 261/70 |
| 6,773,588 | B1 * | 8/2004 | Beeman et al. | 210/232 |
| 6,846,407 | B1 * | 1/2005 | Anderson et al. | 210/167 |
| 2002/0100716 | A1 | 8/2002 | Bosko | |
| 2003/0230522 | A1 * | 12/2003 | Pavel | 210/137 |

FOREIGN PATENT DOCUMENTS

| | | |
|---|---|---|
| JP | 63-270592 | 11/1988 |
| JP | 4-124535 | 4/1992 |
| JP | 5-296505 | 11/1993 |
| JP | 7-293953 | 11/1995 |
| JP | 11-300341 | 11/1999 |

OTHER PUBLICATIONS

Exhibit B—"JS When Humidity Matters! PureFlo™ water treatment for humidifiers," *JS Humidifiers plc,* 2 pages (Date: Known to Applicant prior to filing the present non-provisional application).

Exhibit C—"JS When Humidity Matters! Calomax Steam Humidifier Range," *JS Humidifiers plc,* 2 pages (Jul. 2002).

Exhibit D—"HE420A,B and HE460A,B Steam Power Humidifiers—Product Data," *Honeywell,* 12 pages (1998).

Exhibit F—"Installation Instructions & Owner's Manual—Autoflo Electronic Steam Unit—Power Humidifier Models S2000 and S2020 for Gas or Oil Forced Air Furnaces, Heat Pumps and Electric Furnaces," *EWC® Controls Inc.,* 11 pages (Date: Known to Applicant prior to filing the present non-provisional application).

Exhibit G—"Steam Humidifier, Models S2000 and S2020 The World's Most Efficient Humidifier Just Got Better!," http://www.ewccontrols.com/steam_humidifier.htm, 2 pages (Date: Known to Applicant prior to filing the present non-provisional application).

Exhibit H—"Armstrong HumidiClean Suggested Specifications," *Power Specialties Co. Providing Steam Products & Services to Industry,* http://powerspecialties.com/humidiclean_specificat.htm, 4 pages (Date: Known to Applicant prior to filing the present non-provisional application).

Exhibit I—Armstrong HumidiClean™ Humidifier—The Ionic Bed. The Final Resting Place for Ordinary Humidifiers, *Power Specialties Co. Providing Steam Products & Services to Industry,* http://powerspecialties.com/humidiclean_specificat.htm, 5 pages (Date: Known to Applicant prior to filing the present non-provisional application).

Exhibit J—"HumidiClean™ Series HC-4000 Humidifier—Revolutionary ionic bed technology that carries a lot of weight.," *Armstrong International, Inc.,* Bulletin No. 581-C , 12 pages (Oct. 1999).

Exhibit K—"homeSteam elite residential steam humidifier—Installation, Operating and Maintenance Manual," *Carel USA, LLC,* 24 pages (Date: Known to Applicant prior to filing the present non-provisional application).

Exhibit L—"HomeSteam Elite Residential Whole House Humidifier," *Carel USA,* http://www.carelusa.com/homesteam.htm, 3 pages (Date: Known to Applicant prior to filing the present non-provisional application).

* cited by examiner

HUMIDIFIER WITH REVERSE OSMOSIS FILTER

CROSS REFERENCE TO RELATED APPLICATIONS

This reference claims priority to provisional application Ser. No. 60/417,919 filed on Oct. 11, 2002, which application is herein incorporated by reference.

TECHNICAL FIELD

This disclosure relates generally to methods and devices for conditioning air. More particularly, this disclosure relates to a humidifier including a reservoir and heating element.

BACKGROUND

A wide variety of arrangements have been utilized for conditioning air by increasing the air humidity. The benefits of maintaining proper humidity levels in a home are well documented. As the house heats up it can easily become dry. Hardwood floors and stairs creak from a lack of moisture. Other wood furnishing can literally dehydrate and shrink, developing cracks in their finish and gaps between their joints.

A proper humidity level also makes a house more comfortable for people living in it. Dry air can even feel colder than actual thermostat settings. A humidifier system can help lower heating bills by adding humidity, which actually makes the air feel warmer.

There are many types of humidifiers, for example, drum humidifiers, flow-through humidifiers, and steam-powered humidifiers. Drum humidifiers include a pad mounted to a motorized cylindrical drum. A motor rotates the pad through a reservoir of water as air is bypassed through the pad to become humidified. The humidified air is mixed with return air. Humidifier drums however need frequent maintenance, requiring cleanout every month or two to prevent evaporative water buildup in the reservoir and on the pad.

Flow-through humidifiers use a portion of the air supplied by a furnace, which is sent through a bypass duct to generate airflow across a water saturated humidifier pad. The humidified air is then routed back to the return side of the furnace where it is blended with air from the cold air return, heated, and returned to the home environment. Flow through units deliver humidity to the home only when the furnace is operating. In cases where there is not enough furnace run-time, such as in a climate with a mild winter, proper levels of humidity are not maintained.

Steam powered humidifiers are an alternative that provides more consistent humidity because they deliver rated humidification on demand, independent of the furnace run time. A steam powered humidifier typically mounts under a supply or return air duct and has a heating element that boils water in a reservoir when a humidistat calls for additional humidity. If humidity is called for, the system will turn on the furnace fan to distribute the humidity. Similar to the drum humidifiers, however, conventional steam powered humidifiers require frequent cleanout maintenance to eliminate evaporative water buildup in the reservoir and on the heating element.

Whole house residential humidifiers that incorporate water reservoirs are susceptible to multiple modes of failure due to contaminants in the supply water. Systems that use direct immersion heating elements or rotating evaporative drums, act as collectors for solid content, since the water quality on the supply side is uncontrolled. The solid content can accumulate and lead to premature failure of, for example, the heating element in steam humidifiers, or loss of absorptive capacity of the evaporative elements.

Periodic flushing can mitigate the solid content accumulation problem. There are a number of reasons why flushing does not, however, fully address the accumulation of solids. For example, periodic flushing does not remove solids that are deposited to surfaces. Reservoir and drain configurations do not always allow solids to leave the device even when water is flushed through the device. In addition, the quality of water supply varies greatly between municipalities, which makes the application and maintenance of conventional systems difficult unless specific water conditions at the installing location are known.

One of the bigger product issues for steam humidifiers is the failure of the internal heating element. This failure is predominantly attributed to poor water quality causing a residue build-up on the heating element. Over time, this build-up causes the heating element to deteriorate and fail.

In general, improvement has been sought with respect to such humidifier systems, generally to reduce maintenance, improve efficiency, and improve system reliability.

SUMMARY

In one aspect, the present invention relates to a humidifier system including a heating element positioned adjacent to a reservoir for heating filtered fluid within the reservoir. The humidifier system includes a filter assembly capable of filtering particles sized 1.0 micrometers and larger. The humidifier system further includes an electrically activated valve positioned to selectively permit fluid flow from a supply source to the filter assembly.

In another aspect, the present invention relates to a filtering system having a filter assembly capable of filtering particles sized 1.0 micrometers and larger. The filtering system includes a fluid level detection mechanism having first and second float devices to detect the fluid level in a reservoir. The filtering system further includes a flow control valve positioned to selectively provide fluid flow from a supply source to the filter assembly.

In yet another aspect, the present invention relates to a filtering system having a filter assembly capable of filtering particles sized 1.0 micrometers and larger. The filtering system includes a fluid level detection mechanism having a magnet and reed switch to detect the fluid level in a reservoir. The filtering system further includes a flow control valve positioned to selectively provide fluid flow from a supply source to the filter assembly.

In still another aspect, the present invention relates to a humidifier system including a heat source configured to heat fluid with a reservoir. The humidifier system includes a filter assembly capable of filtering particles sized 1.0 micrometers and larger. The humidifier system further includes an electrically activated valve positioned to selectively permit fluid flow from a supply source to the filter assembly, and a fluid level detection mechanism.

A variety of aspects of the invention are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are exemplary and explanatory only, and are not restrictive of the claimed invention.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

I. General Overview

Figure 1:
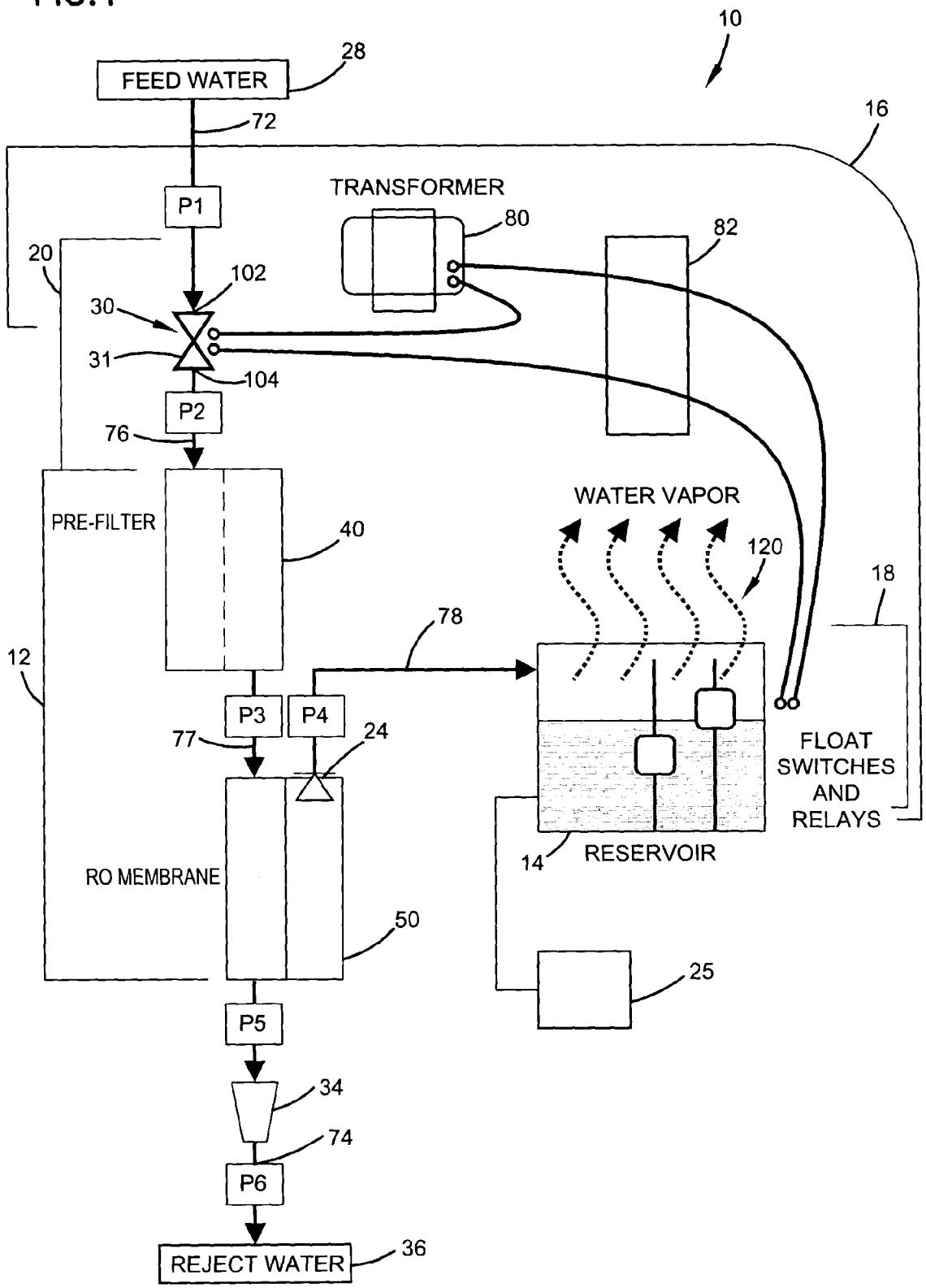
FIG. 1 is a schematic representation of one embodiment of a humidifier system in accord with the principles disclosed.

FIGS. 1–9 illustrate a humidifier system 10 having features that are examples of how inventive aspects in accordance with the principles of the present disclosure may be practiced. FIG. 1 schematically illustrates one embodiment of the humidifier system 10. The system 10 includes a filter assembly 12, a tank or reservoir 14 configured to produce steam, and a control system 16. The control system 16 includes a fluid level detection mechanism 18 and a flow control device 20 that controls the flow of a supply fluid, such as water, from a fluid supply pressure source 28 to the reservoir 14.

The system 10 is used to humidify air within a home, for example. Humidifier system 10 allows the homeowner to keep their furnishing at home in good condition and to live in a consistently comfortable environment with a system that requires low maintenance. It is contemplated the present system can be used in a variety of applications, other than a home, where it is desirable to humidify the environment.

Figure 2:
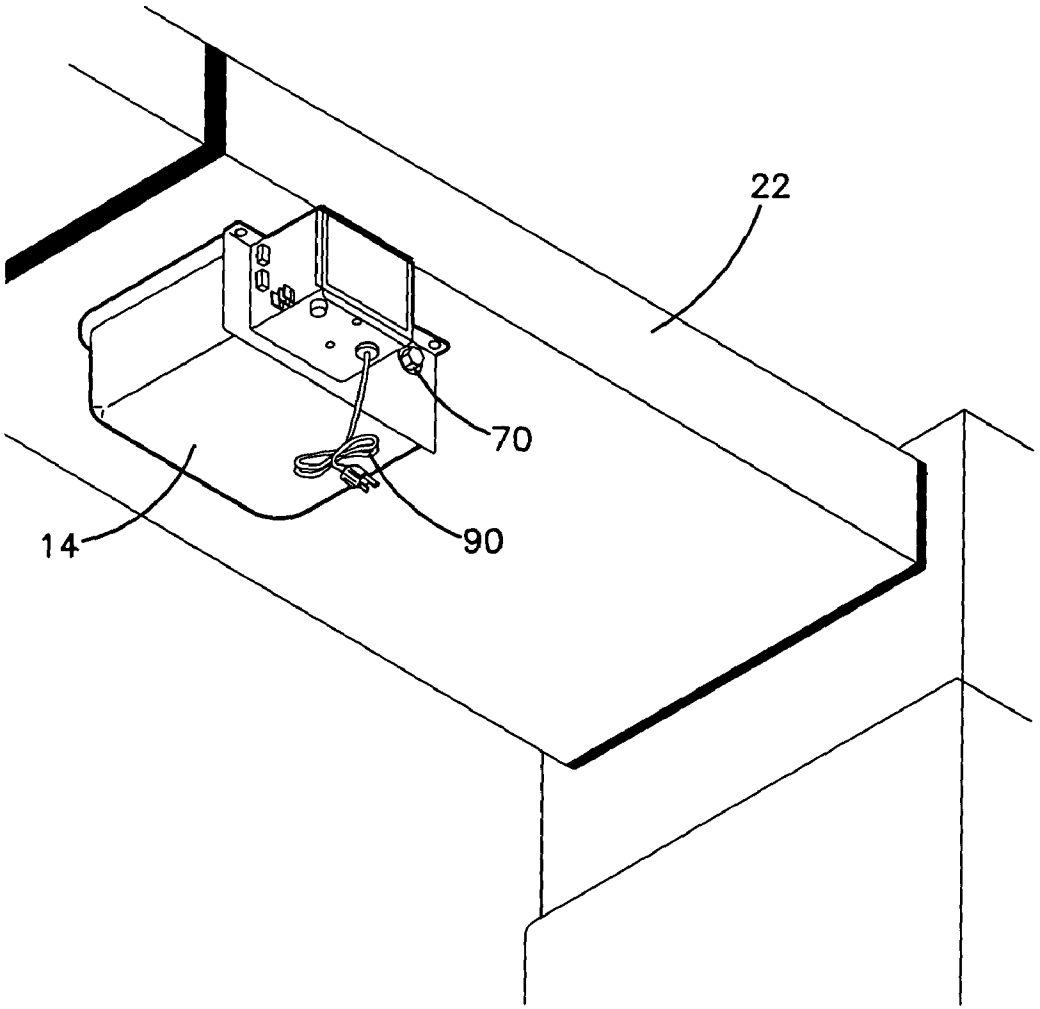
FIG. 2 is a bottom perspective view of one embodiment of a reservoir of the humidifier system that is schematically represented in FIG. 1.

FIG. 2 illustrates one installation configuration. The reservoir 14 is mounted to the underside of an air duct 22. Other mounting configurations are contemplated, such as mounting the reservoir 14 to the side of an air duct or an extension of an air duct. The filter assembly 12 (shown in FIG. 3) can be mounted adjacent to the reservoir 14 or may be mounted a distance from the reservoir in an area where the filter assembly 12 is more easily accessible, or plumbing is available. Typically the filter assembly 12 is mounted between two exposed wall studs on a wall surface.

II. Components

A. Filter Assembly

The most common type of filtration systems in water treatment is the "normal" mechanical filter where all influent passes through a filter medium that removes contaminants to produce higher quality water. Mechanical filtration systems are effective in removing suspended solids from water, although suspended solids only account for a portion of the total solid contaminants.

The humidifier system 10 of the present disclosure offers a two-stage filtration arrangement or filter assembly 12 that eliminates chlorine, particulates, and other dissolved solids from the water before it passes through to the reservoir 14. The filter assembly 12 prevents residue buildup on system components, dramatically reducing maintenance and component failures that can result in areas with poor water quality.

Figure 3:
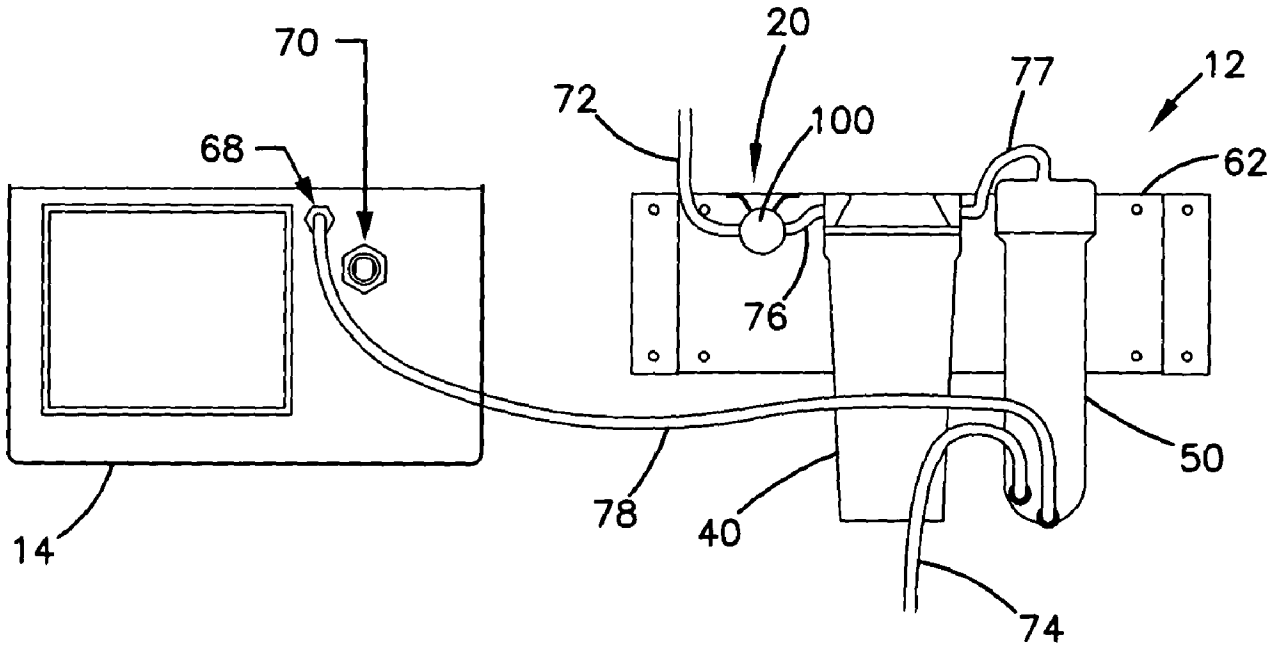
FIG. 3 is another schematic front elevational view of the reservoir shown in FIG. 2, including one embodiment of a filter assembly that is schematically represented in FIG. 1.
Figure 5:
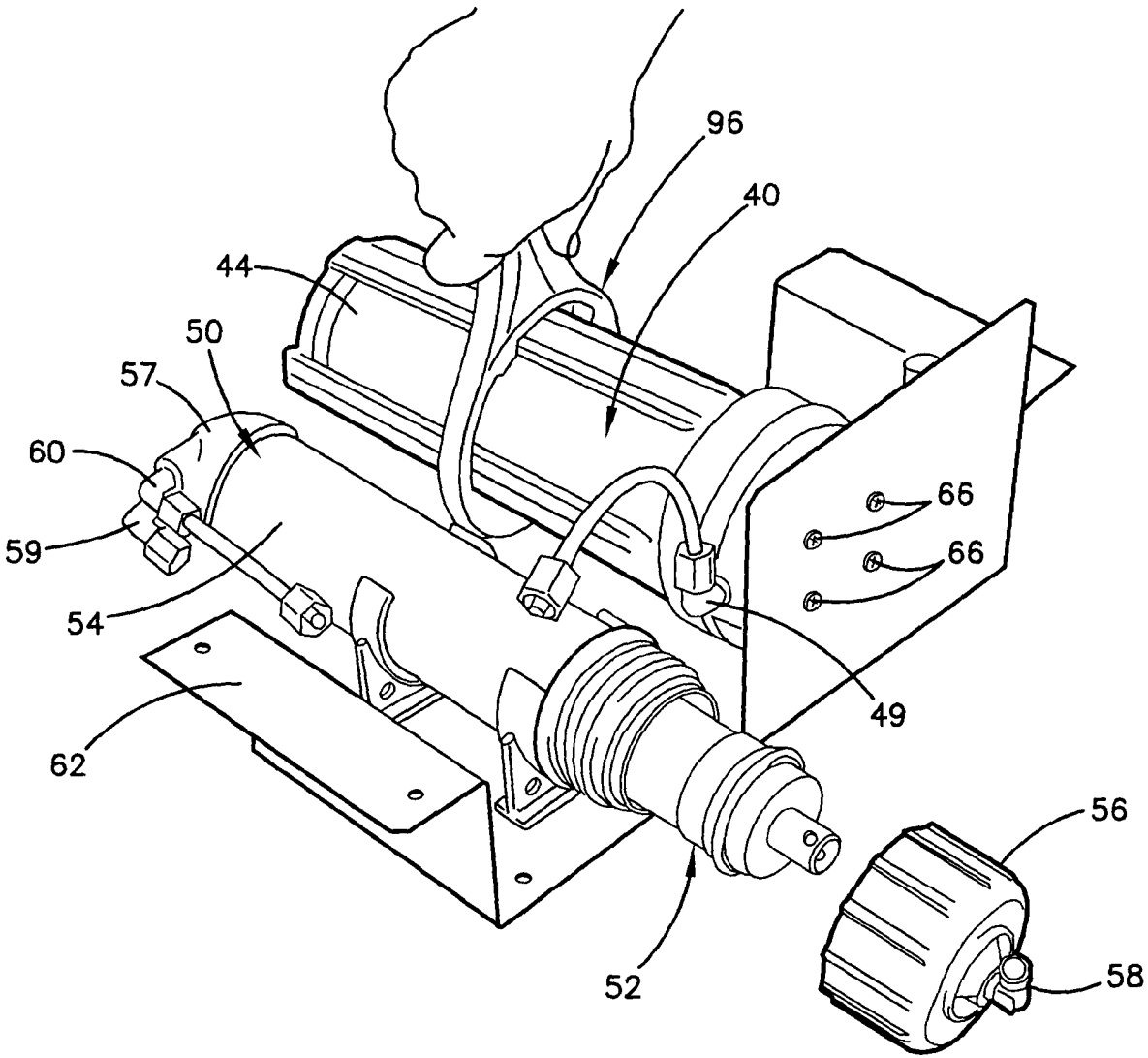
FIG. 5 is a top perspective view of the filter assembly schematically represented in FIG. 3.

Referring generally to FIGS. 3 and 5, the filter assembly 12 of the present disclosure includes a first filter 40 or pre-filter and a second filter 50. It is contemplated that the filter assembly could incorporate a greater number of filters to provide a multi-stage filtration arrangement (i.e. a three-stage, four-stage, (etc.) filtration arrangement) in applications where such filtration is needed. Alternatively, the filter assembly 12 could include only one filter component.

The first filter 40 is arranged in series with the second filter 50. The filter assembly 12 is arranged in series with the reservoir 14 and can be mounted adjacent to the reservoir 14 or a distance from the reservoir 14. In the illustrated embodiment, a bracket 62 is provided to mount the filter assembly 12 at a desired location. Conventional fasteners can be used to secure the mounting bracket 62 at the desired mounting location.

In one embodiment, the filter assembly is capable of eliminating particles having a size of 1.0 micrometers and larger. A filter assembly having the capability of filtering 1.0-sized particles may be referred to as a high-filtration assembly. In another embodiment, the filter assembly is capable of eliminating particles having a size of 0.1 micrometers and larger. A filter assembly having the capability of filtering 0.1-sized particles may be referred to as a micro-filtration assembly. In yet another embodiment, the filter assembly is capable of eliminate particles having a size of 0.01 micrometers and larger. A filter assembly having the capability of filtering 0.01-sized particles may be referred to as a ultra-filtration assembly. In another embodiment, the filter assembly includes a reverse osmosis filter element and the filter assembly is capable of eliminating particles having a size of 0.001 micrometers and larger. A filter assembly having the capability of filtering 0.001-sized particles may be referred to as a hyper-filtration assembly.

1. First Filter Component

Figure 6:
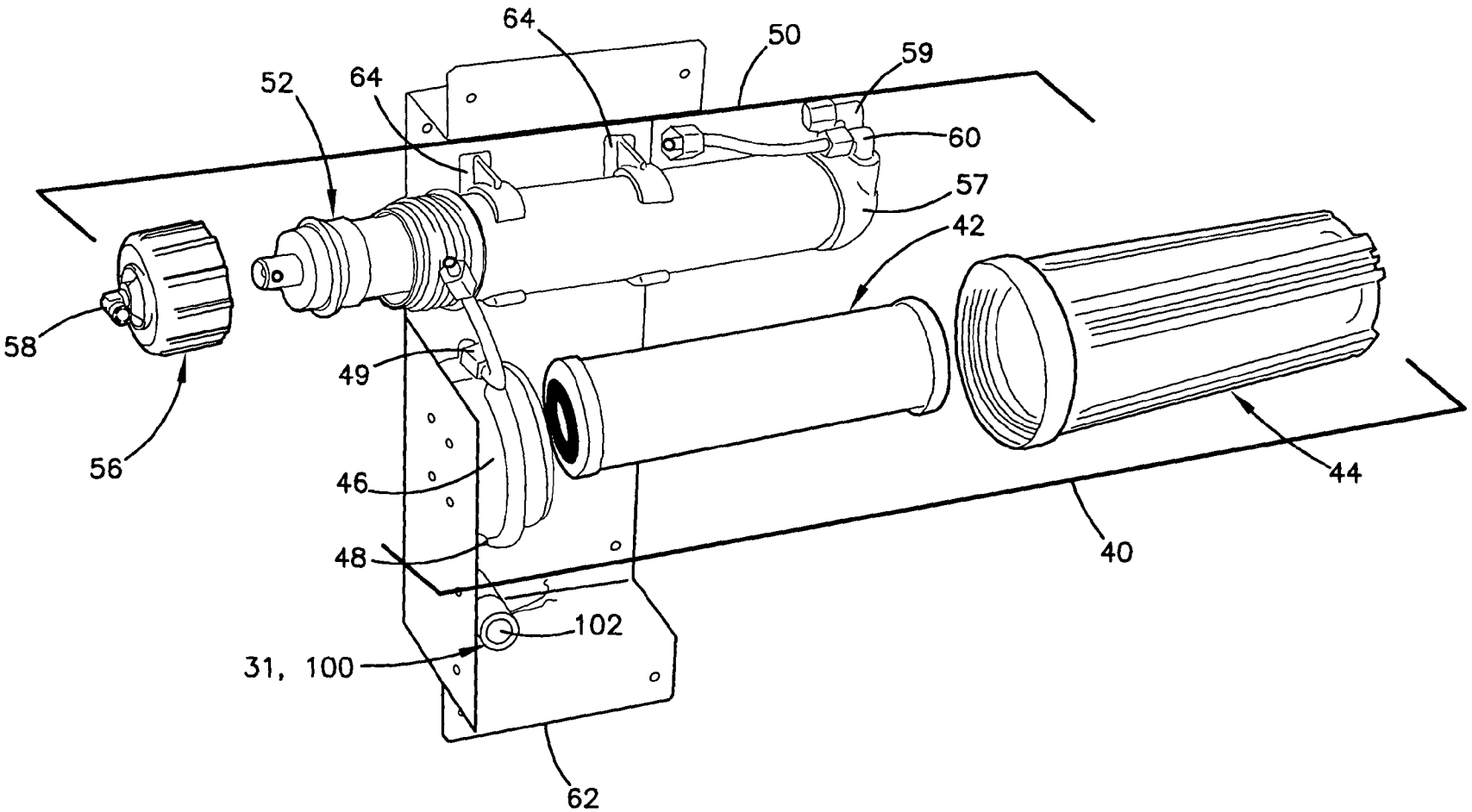
FIG. 6 is a partially exploded, front perspective view of the filter assembly of FIG. 5.
Figure 7:
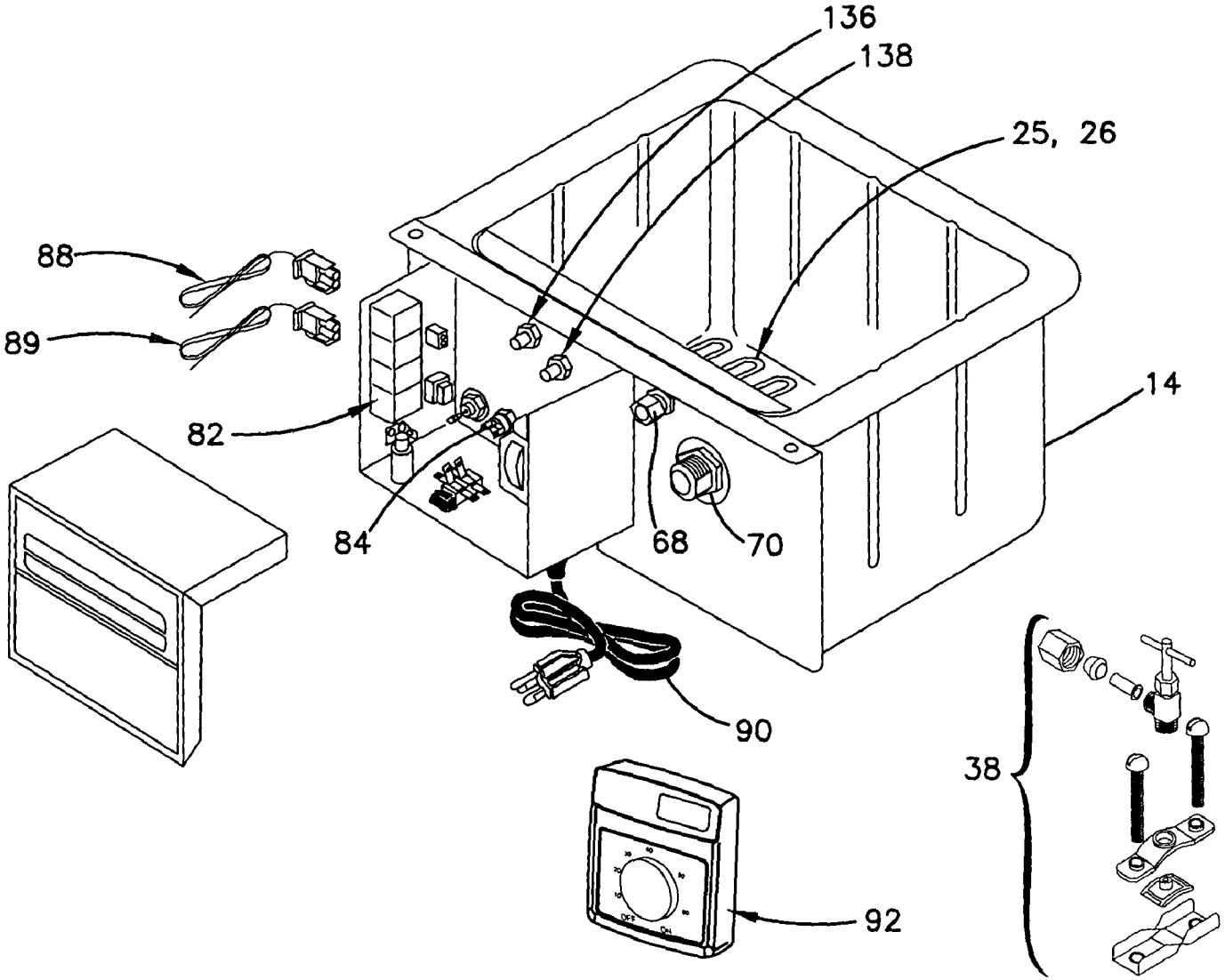
FIG. 7 is a partially exploded, front perspective view of the reservoir shown in FIG. 4.

Referring now to FIG. 6, the first filter 40 includes a filter cartridge 42, a filter housing 44, and an end cap 46. The first filter 40 also includes an inlet 48 and an outlet 49. In the illustrated embodiment, the inlet 48 and outlet 49 are located in the end cap 46. The inlet 48 of the end cap 46 is in selective fluid communication with the fluid pressure source 28 (FIG. 1). The outlet 49 is in fluid communication with the second filter 50.

As shown in FIG. 5, the filter assembly 12 includes mounting structures 66 to mount the end cap 46 of the first filter 40 to the mounting bracket 62. The mounting structures 66 can include fasteners that extend through holes in the bracket 62 and engage with the end cap 46 to secure the end cap in position. Referring back to FIG. 6, the filter housing 44 detachably secures to the end cap 46. The housing can detachably secure to the end cap by a snug interference fit, or can include threads that engage with corresponding threads of the end cap. As shown in FIG. 5, a speciallyadapted hand tool 96 may be used to connect and disconnect the filter housing 44 to and from the endcap 46.

In one embodiment, the first filter can include a particulate filter cartridge 42 designed to remove large suspended solids, along with an adsorbent material to remove chlorine. Such particulate filters include standard carbon pre-filter elements that filter chlorine from supply water as well as roughly filter suspended solids. These standard filters can include cartridges or bag filters that remove residual insoluble material of up to 0.5 microns. Such filters can also remove turbidity and oxidized metals, like iron and manganese. One example of a standard carbon pre-filter element is a CTO/3 Carbon Filter manufactured by Yeu Chemg, Taiwan Model No.: 120-099-6658-952. Many other types of particulate filter cartridges can be used in accordance with the principles disclosed. Another example of a particulate filter that can be used is Model: C FX UTC, manufactured under the trademark SMARTWATER by General Electric.

The first filter 40 is arranged to pre-treat the feed water from the fluid pressure source 28 prior to the second filter 50. In an alternative embodiment chemical pumps can inject acid or antiscalants to keep salt soluble, or biocontrol agents to prevent biofouling.

2. Second Filter Component

As shown in FIG. 6, the second filter 50 of the filter assembly 12 includes a filter membrane assembly 52, a second filter housing 54, a first end cap 56, and a second end cap 57. The second filter 50 also includes an inlet 58 and first and second outlets 59, 60. In the illustrated embodiment the inlet 58 is located at the first end cap 58. The first and second outlets 59, 60 are located at the second end cap 57. The inlet 58 of the second filter 50 is in fluid communication with the outlet 49 of the first filter 40. The first outlet 59 of the second filter 50 is in fluid communication with the reservoir 14 of the humidifier system 10. The second outlet 60 of the second filter 50 is plumbed to drain 36 (shown schematically in FIG. 1). Standoff brackets 64 can be provided to mount the second filter assembly 50 to the filter assembly mounting bracket 62.

The filter membrane assembly 52 includes a semi permeable membrane that passes through water molecules but will not pass a great percentage of the solutes (i.e., dissolved material). The semi permeable membrane can consist of a spiral wound, parallel-flow, membrane. The nature of the spiral wound, parallel-flow membrane provides for the flushing of the membrane to remove rejected contaminants from the membrane's surface, thereby extending the life of the filter element.

In particular, the second filter arrangement provides parallel flow and cross flow through the second filter. This type of filtration is more commonly referred to as reverse osmosis (RO). In RO filtration, a portion of the incoming feed water (the parallel flow) is used to carry away contaminants. The flow carrying away the contaminants can be referred to as rejection water. The rejection water or parallel flow continuously sweeps the membrane surface, minimizing buildup of rejected impurities to allow free flow of purified water into the reservoir. This provides consistent performance and reduces the need for frequent membrane assembly replacement. The flow that passes through the membrane is the cross flow. In general, the two-stage filter assembly 12 of the disclosed humidifier system 10 removes particulate, chlorine, and virtually all other contaminants from the water. Therefore, the components of the system 10 remain clean, resulting in decreased maintenance and failure. One example of a reverse osmosis filter is manufactured by FILMTEC Corp., Model No. TW30-1812-50.

The humidifier system 10, shown schematically in FIG. 1, is configured to operate on water line pressure typical of residential systems (less than 125 psi). In one application, the flow control device 20 of the humidifier system is linked to a fluid pressure source 28 rated at about 50–60 psi so that a sufficient pressure differential is provided across the second filter 50 of the filter assembly. The filter assembly 12 is sized accordingly to provide flow capacity to process and deliver a sufficient volume of purified feed water to the reservoir 14 to keep up with the system's delivery rate of humidity. For example, the first and second filters 40, 50 are sized for consideration of allowing for declining output due to cartridge 42 or membrane assembly 52 fouling. In typical applications, the filter assembly 12 is sized to provide purified water output of approximately 50 gallons per day.

The filter assembly 12 is designed such that contaminants not discharged in the wastewater (rejection water) are captured by the first and second filters 40, 50. The first and second filters 40, 50 are arranged so that they are easily replaceable by a homeowner. The average life of the pre-filter or first filter 40 is about one year (six months of operating time). The average life of the second filter 50 is about two years (one year of operating time). It is to be understood, however, that each filter's lifetime is subjective, based upon the quality of water that is being supplied, and how much humidification is required in the home.

The process of reverse osmosis and the rejection of dissolved materials takes place under pressure, with the purified water (the cross flow) passing across the semi-permeable membrane to a lower pressure region (i.e. atmosphere). It is not mechanical filtration, such as you would find in conventional filter assemblies having only a single cartridge filter. In such mechanical filtration arrangements, all the solution passes through the filter media and some of the suspended material in solution is caught by direct interception or inertial impaction on the filter media. Rather, in the reverse osmosis second filter, the pre-filtered feed water passes over the membrane, and pressure forces a percentage of the feed water, in purified form, through the membrane. At the same time, the remaining percentage of the feed water, carries away contaminates in the form of rejection water.

Pressure is provided by the fluid pressure source 28 when fluid communication is permitted to the filter assembly 12. Pressure is partially maintained by a restrictor 34 positioned prior to the drain 36. The restrictor creates a constrained flow to drain 36 so that feed water is directed through the membrane assembly 52 of the second filter 50, while still permitting flushing of rejected contaminants.

Conventional reverse osmosis water treatment systems that employ a rejection water configuration to flush contaminants from a filter element generally use an automatic shutoff assembly to turn off the feed water and conserve water when there is no demand for purified water. Generally, automatic shutoff assemblies include a simple mechanical diaphragm valve mechanism, activated by the pressure of the fluid that has not yet passed through the filter. In some situations, however, rejection water can be continuously generated: for example, when the rate at which the diaphragm valve closes does not generate a back pressure sufficient to cause the automatic shutoff assembly, i.e. diaphragm switch, to positively close; or line pressures are either too low or too high to allow the proper operation of the diaphragm switch. In order to promote water conservation if this condition exists, a device for rapidly and positively shutting off water to the filter assembly is needed.

B. Reservoir/Heating Element

In the illustrated embodiment, a one-way valve or check valve 24 positioned between second filter 50 of the filter assembly 12 and the reservoir 14. The check valve 24 permits one-way fluid flow from the filter assembly 12 to the reservoir 14. The check valve is arranged so that purified water leaving the second filter 50 is not permitted to back flow into the second filter 50. In the illustrated embodiment, the check valve 24 is positioned at the first outlet 59 of the second filter 50. It is contemplated that the check valve 24 can be located at any point along the fluid pathway 78 between the second filter 50 and the reservoir 14.

Figure 4:
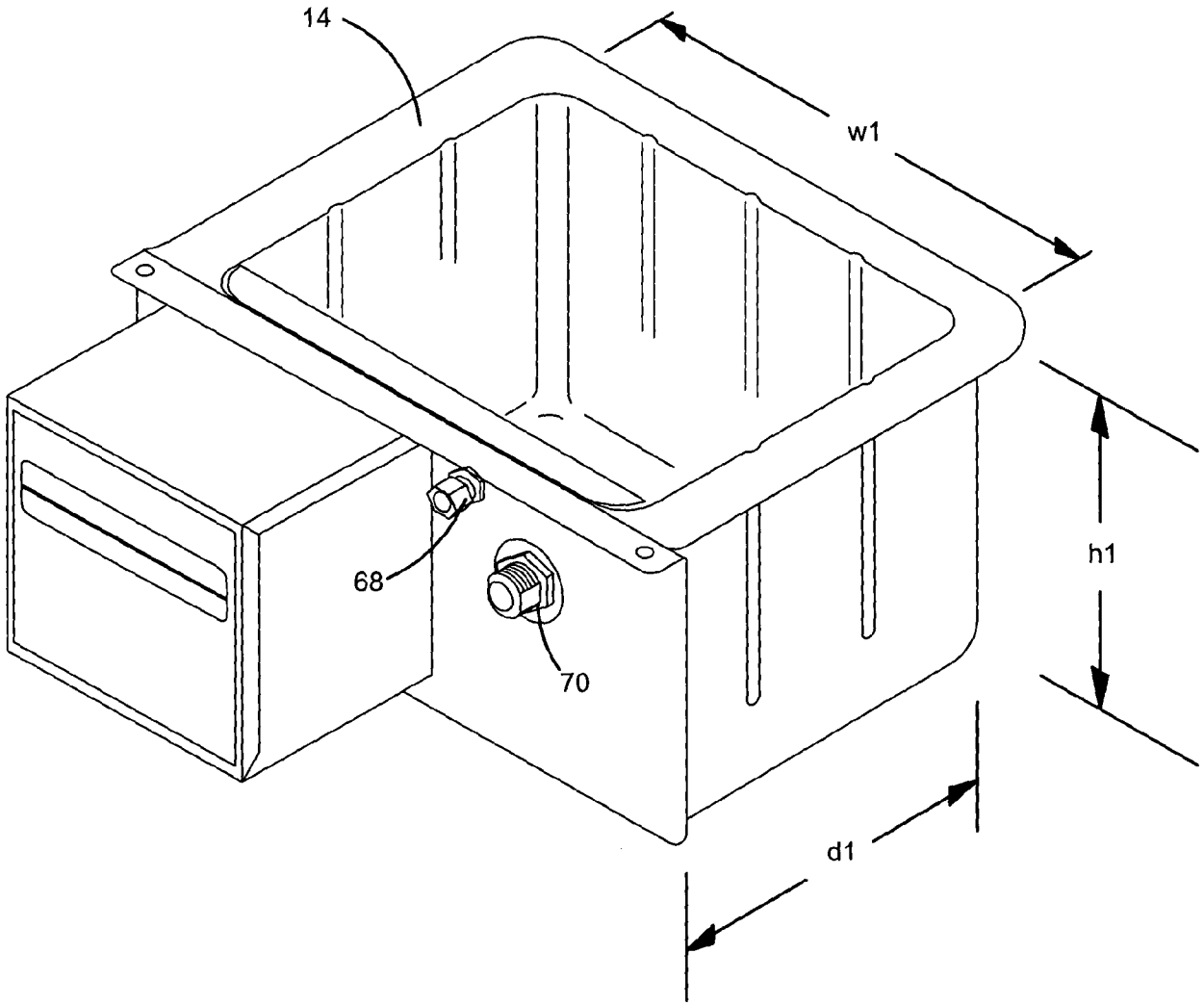
FIG. 4 is front perspective view of the reservoir shown in FIG. 2.

As shown in FIG. 4, the reservoir 14 includes a fluid input port 68 and an overflow or output port 70. A drain port (not shown) may be located at the bottom of the reservoir 14. In the illustrated embodiment, the overflow 70 includes a bulkhead fitting. The fluid input port 68 is in fluid communication with the first outlet 59 (FIG. 6) of the second filter 50. The overflow bulkhead 70 can be connected to drain (not shown).

The reservoir 14 is sized to keep up with the demand for humidity within the home. In one embodiment, the reservoir is of a seamless drawn metal construction having a height h1, a width w1 and a depth d1. In the illustrated embodiment, the height h1 is approximately 5.5 inches, the width w1 is approximately 10.5 inches, and the depth d1 is approximately 8.5 inches. Other reservoir sizes and constructions, configured to meet the operating requirements of the humidifier system, can be used.

The humidifier system 10 includes a heat generation source 25 (FIG. 1). The heat source 25 operates to heat water within the reservoir 14 to produce steam. The heat source 25 may be positioned within the reservoir 14 or external to the reservoir 14. A gas-fired heater is an example of an external heating source that may be used in one embodiment. In another embodiment, the heat source 25 includes a heating element 26 located within the reservoir 14. In use, the heating element 26 is immersed within the water and heats the water to a temperature at which steam is produced. The heating element 26 is sized in accordance with the reservoir 14 to keep up with the demand for humidity within the home. In one embodiment, the heating element 26 is rated to expend about 1,500 to 2,000 watts of electricity. The immersed heating element can include, for example, a nickel-plated brass sheath element.

C. Control System

As shown in FIG. 1, the control system 16 includes a fluid level detection mechanism 18 and a flow control device 20 that controls the flow of a supply fluid, such as water, from a fluid supply pressure source 28 to the reservoir 14. The control system 16 can be located adjacent the reservoir 14. In the alternative, the control system can be mounted at an area located away from the reservoir 14 provided the proper electrical connections are available.

1. Flow Control Device

The flow control device 20 of the control system 16 includes a valve arrangement 30 (FIG. 1). In one embodiment, the valve arrangement 30 is an electrically actuated valve arrangement 31 (FIG. 6) selectively operated by signals generated by the fluid level detection mechanism 18. The electrically actuated valve arrangement 31 provides the advantage of rapid, positive actuation. Other types of valves, other than electrically actuated valves, operating with rapid and positive actuation can be used. For example, in alternative embodiments, a rapid-actuating ball valve or spring-assisted mechanical arm could be used. In the remainder of the present disclosure, the system 10 will be described with use of an electrically actuated valve arrangement 31.

In one embodiment, the electrically actuated valve arrangement 31 includes a solenoid valve 100 having an inlet 102 and an outlet 104. The inlet 102 is in fluid communication with the fluid pressure source 28. The outlet 104 is in selective fluid communication with the inlet 48 of the first filter 40.

In the illustrated embodiment, the solenoid valve 100 is a normally-closed solenoid valve. The normally-closed solenoid valve 100 closes fluid communication between the fluid pressure source 28 and the filter assembly 12 when the valve 100 is de-energized. (The solenoid valve is de-energized when an electrical current is not supplied to the valve.) When the solenoid valve 100 is energized (i.e. an electrical current is supplied), the solenoid valve 100 opens fluid communication between the fluid pressure source 28 and the filter assembly 12. In accord with the previously described filter assembly 12, rejection water is thereby expended only when the solenoid valve 100 is energized.

Because the filter assembly 12, in particular the second filter 50, has a performance rating which is a function of the pressure differential across the membrane assembly 52, it is recommended to operate the humidifier system 10 in a fully open state or a fully closed state only. The electrically activated solenoid valve 100 ensures a rapid and reliable change in state from a fully open position to a fully closed position, even against a wide range of supply line pressures.

Unlike conventional shutoff valve assemblies previously described, the control system 16, including the solenoid valve 100 and the fluid level detection mechanism to sense the water level at which the solenoid valve 100 should be activated, maintains the proper water level and positively stops rejection water from being generated. By providing the desired fully open and fully closed positions, the solenoid valve 100 increases the performance, efficiency, and life of the humidifier system 10.

An added benefit of the disclosed control system 16 is that the normally-closed solenoid valve 100 allows for system maintenance, such as filter replacement, without the need to manually close a line to the fluid pressure source 28 to prevent inadvertent water discharge. In an alternative embodiment, the solenoid valve may be normally open when not energized, and may close when energized.

2. Fluid Level Detection Mechanism

The operation of the solenoid valve is controlled by the fluid level detection mechanism. In one embodiment the fluid level detection mechanism provides a large switch differential to minimize the number of solenoid valve cycles, thereby extending the life of the valve. In addition, when the system is providing purified water to a steam humidification system, the water surface can become severely agitated during times of steam generation or boiling. This large switch differential eliminates the possibility of rapid cycling of the solenoid valve due to the unstable water surface condition.

The large switch differential can be accomplished through the use of multiple water level sensors that define an upper water level limit and a lower water level limit for a normal fill cycle. The upper and lower water level limits define when the solenoid valve is opened or closed. The height between the upper water level and the lower water level define an operating range.

Figure 8:
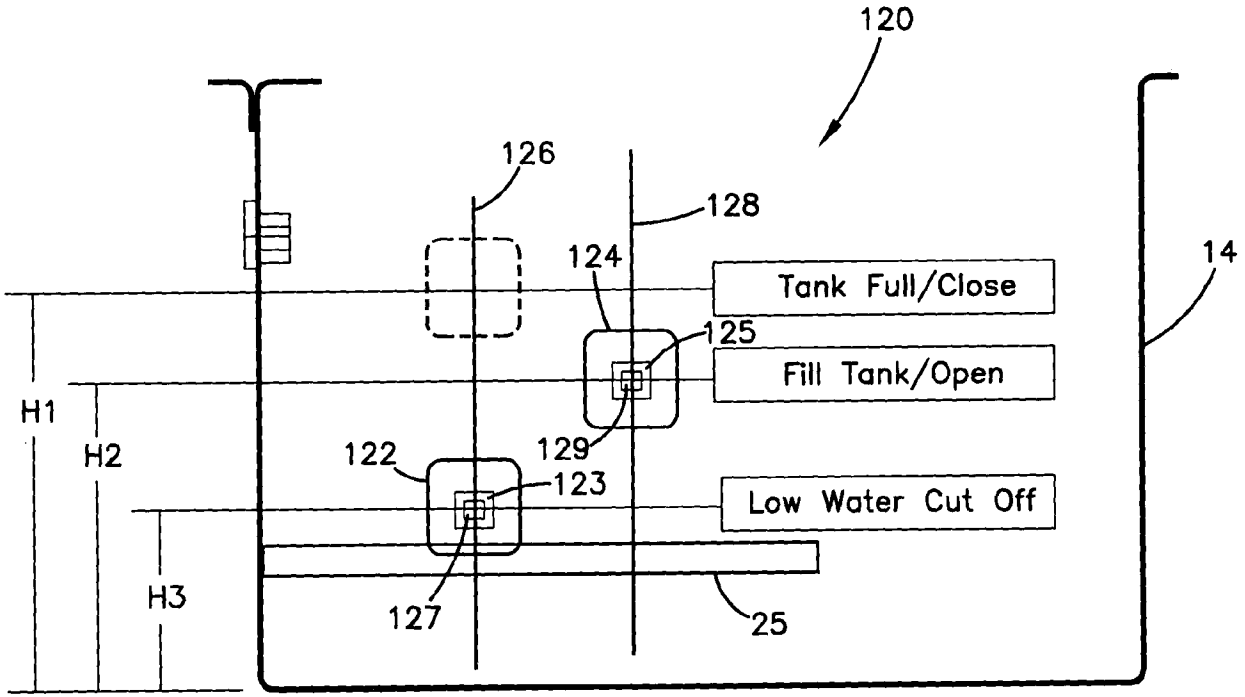
FIG. 8 is a schematic representation of the reservoir shown in FIG. 7, including one embodiment of a fluid level detection mechanism.

The illustrated fluid level detection mechanism 18, shown in FIG. 8, includes a float assembly 120. The illustrated float assembly includes a first float 122 mounted on a first stem 126, and a second float 124 mounted on a second stem 128.

The floats 122, 124 each include a magnet 123, 125. The first and second stems 126, 128 are mounted to the reservoir 14 at connections 136, 138, shown in FIG. 7 (the stems are positioned within the reservoir 14). Each of the first and second stems 126, 128 include at least a first reed switch 127, 129. In operation, the reed switches change position to either open or close a contact when the float changes height relative to the reed switch. The contacts are electrically connected to a relay assembly 82 (FIGS. 1 and 7) that selectively energizes or de-energizes the solenoid valve 100 (FIG. 1). The transformer 80 provides low voltage power to the relay assembly 82.

III. Operation

A. Installation Generally

In use, the reservoir 14 (shown in FIG. 2) is mounted to duct work 22 in the home. The humidifier is ideally positioned in a location where an electrical cord 90 of the humidifier system 10 can be plugged in without an extension cord. The electrical cord 90 can be electrically coupled to a transformer 80 (FIG. 1) for components requiring low voltage power. The ideal location is also convenient for running a feed water supply line 72 (FIG. 1), a drain line 74, wiring 88 (FIG. 7) between the humidifier and the filter assembly, and wiring 89 between the humidifier and the fan of the home furnace. The filter assembly 12 can be mounted adjacent to the reservoir 14 or mounted at a location providing more convenient access to the filter assembly 12 by a homeowner.

A connection is made into an existing water line to access the fluid pressure source 18. The connection can include, for example, a conventional saddle valve 38 (shown in FIG. 7), which is self-piercing when installed on a copper pipe. Now referring to FIGS. 1 and 3, the feed water supply line 72 is coupled to the inlet 102 of the solenoid valve 100. A first feed line 76 is attached between the outlet 104 of the solenoid valve 100 and the inlet 48 of the first filter 40. A second feed line 77 is attached between the outlet 49 of the first filter 40 and the inlet 58 of the second filter 50. A third feed line 78 is attached between the first outlet 59 of the second filter 50 and the fluid input port 68 of the reservoir 14. A rejection water line or drain line 74 is attached to the second outlet 60 of the second filter 50 and routed to drain 36.

In one embodiment, the feed water supply line 72 running from the saddle valve 38 to the solenoid valve 100 can include one-fourth inch OD polypropylene or copper tubing. The first feed line 76 running from the solenoid valve 100 to the first filter 40 can include one-fourth inch OD polypropylene or copper tubing. The second feed line 77 running from the first filter 40 to the second filter 50 can include one-fourth inch OD polypropylene or copper tubing. The third feed line 78 running from the second filter 50 to the reservoir 14 can include one-fourth inch OD copper tubing. The drain line 74 can include one-half inch ID drain line, made of polypropylene or PVC, for example. The above material specifications are exemplary specifications. Other types of tubing and line configurations are contemplated.

B. Normal Humidification Operations

Humidifiers operate under the principle that as dry air and vapor mix, the relative humidity of the air rises. A humidistat 92 (FIG. 7) monitors the relative humidity and activates the humidifier system 10 accordingly. Typically, the humidistat 92 is located in the home living space near the thermostat. In general, when the humidistat 92 calls for humidity, the heating element 26 starts heating the water in the reservoir 14. A thermal sensor switch 84 on the reservoir senses the temperature of the water in the reservoir 14. When the water is heated to a predetermined first temperature, the thermal sensor switch 84 activates the relay assembly 82 that turns on the furnace fan (not shown).

The warm dry air is routed through the humidifier system 10. Water vapor from the humidifier is picked up by the air and the humidified air is then circulated throughout the home by the furnace fan. When the humidistat 92 determines that the desired level of humidity in the home has been reached, the heating element 26 in the reservoir 14 is turned off. The fan continues to circulate the air until the water in the reservoir 14 cools to a second predetermined temperature. In typical applications, the first predetermined temperature is about 170° F. and the second predetermined temperature is about 120° F.

In the alternative, the water could cool to the second predetermined temperature while the heating element is still on. To illustrate, as the heating element 26 generates steam, the water level in the reservoir 14 decreases. The system 10 refills the reservoir 14 with cold water when the water level reaches a certain point, as is described in greater detail hereinafter. If the replenished water is cooled to a temperature at or below the second predetermined temperature, the thermal sensor switch 84 would shut off the furnace fan until the water temperature again reaches a steam-producing temperature, assuming the call for humidity from the humidistat 92 is unchanged.

When the water level in the reservoir decreases, the fluid level detection mechanism 18 electrically communicates with the flow control device 16 to refill the reservoir. The float assembly 102 operates to maintain the water level in the reservoir 14 between a first predetermined height H1 and a second predetermined height H2, shown in FIG. 8.

In the illustrated embodiment, the second float 124 of the float assembly 120 is configured as a low fluid level float 124. The low level float 124 generates a signal when the water level in the reservoir 14 is at the second predetermined height H2. As illustrated, the second predetermined height H2 is less than or lower than the first predetermined height H1, generally at a level where it is desirable to begin filling the reservoir 14.

When the water level is at the second predetermined level H2, the second float 124 correspondingly floats or follows the water level to a position where the magnet in the second float 124 causes the reed switch in the second stem 128 to change states and generate a begin-fill or low-water signal. The low-water signal is sent to the relay assembly 82, which energizes the solenoid valve 100 to open fluid communication between the fluid pressure source 28 and the filter assembly 12.

The first float 122 of the float assembly 120 in the illustrated embodiment is configured as a high fluid level float 122. The high level float 122 generates a signal when the water level in the reservoir 14 is at the first predetermined height H1. As illustrated, the first predetermined height is generally at a fill level not to be exceeded. When the water level is at the first predetermined level H1, the first float 122 correspondingly floats or follows the water level to a position where the magnet in the first float 122 causes the reed switch in the first stem 126 to change states and generate a stop-fill or high-water signal. The high-water signal is sent to the relay assembly 82, which de-energizes the solenoid valve 100 to close fluid communication between the fluid pressure source 28 and the filter assembly 12.

In the illustrated embodiment shown in FIG. 8, the first predetermined height H1, the position at which the first reed switch (not shown) is positioned within the first stem 126 to switch or generate a high-water signal, is approximately 80 mm from the bottom of the reservoir 14. The second predetermined height H2, the position at which the second reed switch (not shown) is positioned within the second stem 128 to switch or generate a low-water signal, is approximately 65 mm from the bottom of the reservoir 14. This provides an operating height differential of approximately 15 mm within which water can be heated to generate steam, prior to the addition of non-heated water.

Referring back to FIG. 1, it can be understood that that humidifier system 10 is only pressured in the region from the fluid pressure source 28 to the inlet 102 of the solenoid valve 100, which includes the feed water supply line 72. The remaining components—the outlet 104 of the solenoid valve, the filter assembly 12, the first, second, and third feed lines, the restrictor 34, and the drain line 74—are non-pressurized when the solenoid valve is de-energized.

C. Abnormal Operation

The disclosed humidifier system 10 includes three features to respond to abnormal operating conditions: a built-in overflow, a low-water cutoff switch, and a thermal cutoff switch.

The built-in overflow or bulkhead 70 of the reservoir 14 is positioned and configured to direct excess fluid to drain in the event the reservoir should over fill, i.e. the system 10 continues to fill above the first predetermined height H1. The bulkhead 70 is sized to drain a volume of water at a rate equivalent to or greater than the rate at which water can be added to the reservoir 14.

In contrast, the humidifier system 10 is configured to detect a situation when the water level becomes too low. As shown in FIG. 8, the first float 122 of the float assembly can also be configured as a heater-shutoff float. The heater-shutoff float 122 generates a power-cutoff signal when the water level in the reservoir is at a third predetermined height H3. As illustrated, the third predetermined height H3 is less than or lower than the second predetermined height H2, generally at a level where operation of the heater could be unsafe. When the water level is at the third predetermined level H3, the first float 122 correspondingly floats or follows the water level to a position where the magnet in the first float 122 causes a third reed switch (not shown) in the first stem 126 to change states and generate the power-cutoff signal. The shutoff signal is sent to the relay assembly 82, which powers down the heating element until maintenance is performed on the humidifier system 10. In the illustrated embodiment, the third predetermined height H3, at which the reed switch (not shown) of the first float 122 is configured to switch or generate a power-cutoff signal, is approximately 50 mm from the bottom of the reservoir 14.

Figure 9:
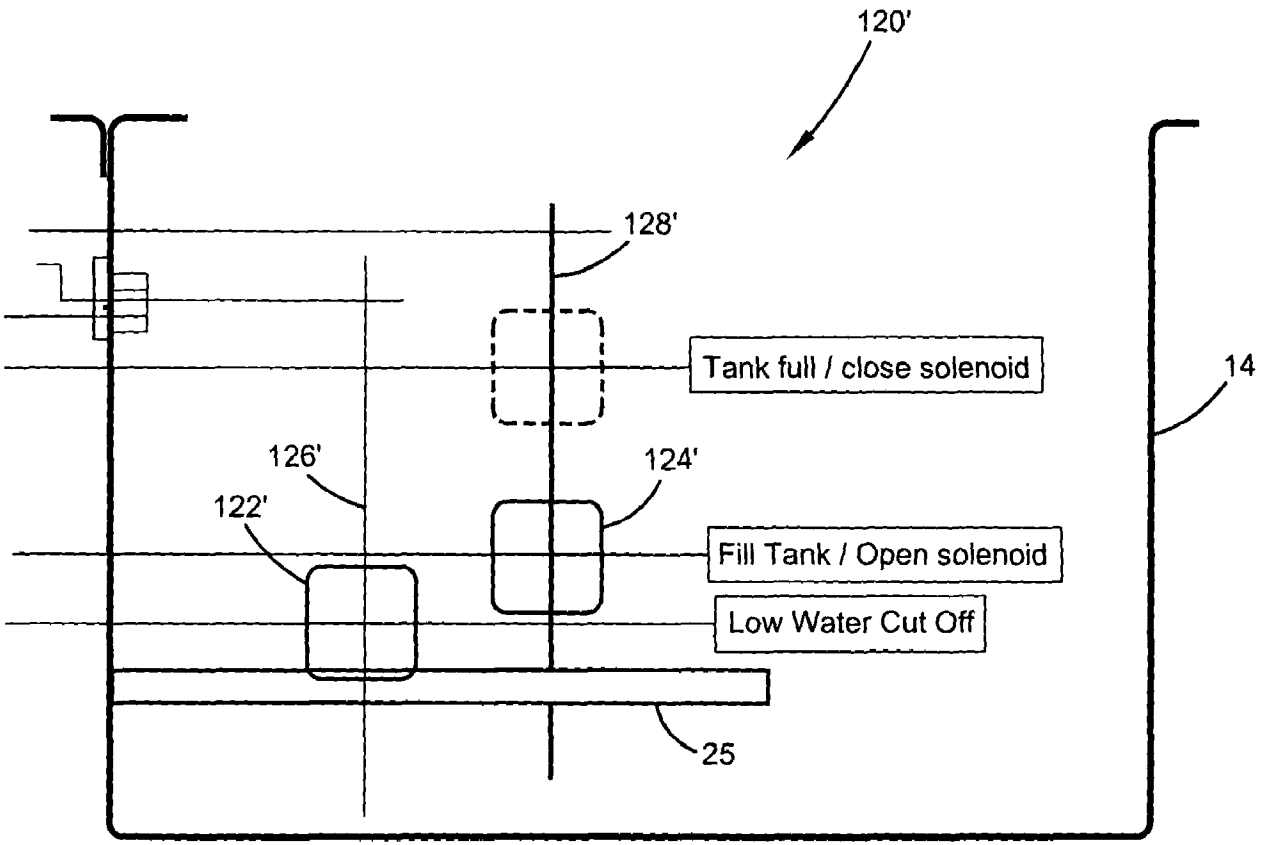
FIG. 9 is a schematic representation of the reservoir shown in FIG. 7, including another embodiment of a fluid level detection mechanism.

It is contemplated that the power-cutoff configuration could also be incorporated into the second float 124 and second stem 128. That is, the second float 124 could be configured to generate a shutoff signal so that the relay assembly 82 powers down the heating element when the water level reaches the third predetermined height H3. Still, in another embodiment as shown in FIG. 9, the float assembly 120' could include a first float and stem configuration 122', 126' that function only to generate the shutoff signal, and a second float and stem configuration 124', 128' that operates to generate both the begin-fill and stop-fill signals.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A humidifier system, comprising:

a) a reservoir configured to contain a fluid;

b) a heat source configured to heat fluid within the reservoir; and c) a filter assembly for filtering the fluid prior to its flowing into the reservoir;

d) an electrically-activated valve positioned to selectively permit fluid flow from the supply source to the filter assembly; and e) a fluid level detection mechanism to detect the fluid level in the reservoir wherein the fluid level detection mechanism is operatively connected to the electrically activated valve.

2. The humidifier system of claim 1, wherein the electrically activated valve is a solenoid valve.

3. The humidifier system of claim 1, wherein the heat source is a heating element within the reservoir.

4. The humidifier system of claim 1, wherein the heat source is applied to the exterior of the reservoir to heat the fluid.

5. The humidifier system of claim 1, wherein the fluid level detection mechanism includes at least a first float device that senses the level of the fluid in the reservoir to control the fluid flow from the supply source to the filter assembly.

6. The humidifier system of claim 5, wherein the first float device includes a magnet and a reed switch.

7. The humidifier system of claim 5, wherein the first float device is a high fluid level float that generates a signal to the electrically-activated valve to close fluid flow to the filter assembly when the fluid level is at a predetermined first height.

8. The humidifier system of claim 5, wherein the fluid level detection mechanism includes a second float device that operates in cooperation with the first float device to control the fluid flow from the supply source to the filter assembly.

9. The humidifier system of claim 8, wherein the second float device is a low fluid level float that generates a signal to the electrically-activated valve to open fluid flow to the filter assembly when the fluid level is at a predetermined second height.

10. The humidifier system of claim 1, wherein the filter assembly is capable of eliminating particles sized 1.0 micrometers and larger.

11. The humidifier system of claim 10, wherein the filter assembly is capable of eliminating particles sized 0.1 micrometers and larger.

12. The humidifier system of claim 10, wherein the filter assembly is capable of eliminating particles sized 0.01 micrometers and larger.

13. The humidifier system of claim 1, wherein the filter assembly comprises a reverse osmosis filter.

14. The humidifier system of claim 13, wherein the filter assembly comprises a chlorine filter in fluid communication with an inlet of the reverse osmosis filter.

* * * * *